US005297342A

United States Patent [19]

Malone

[11] Patent Number: 5,297,342

[45] Date of Patent: Mar. 29, 1994

[54] SAFETY SCISSORS

[75] Inventor: Jason R. Malone, Matthews, N.C.

[73] Assignee: Hoechst Celanese Corporation, Somerville, N.J.

[21] Appl. No.: 906,167

[22] Filed: Jun. 29, 1992

Related U.S. Application Data

[63] Continuation-in-part of Ser. No. 790,849, Nov. 12, 1991, abandoned.

[51] Int. Cl.[5] ..... B26B 13/00

[52] U.S. Cl. ..... 30/233; 30/131; 30/195

[58] Field of Search ..... 30/233, 179, 286, 90.1, 30/120, 194, 195, 196, 197, 233.5, 131

[56] References Cited

U.S. PATENT DOCUMENTS

| | | | |
|---|---|---|---|
| 332,030 | 12/1885 | Young . | |
| 396,444 | 1/1889 | Klein | 30/233.5 |
| 628,722 | 7/1899 | McCarter . | |
| 1,639,617 | 8/1927 | Seavey | 30/131 |
| 1,806,486 | 5/1931 | Mirafuentes . | |
| 1,994,865 | 3/1935 | Onion . | |
| 2,008,631 | 7/1935 | Udkovich . | |
| 2,267,949 | 12/1941 | Reed | 30/195 |
| 2,272,753 | 2/1942 | Steinhardt | 30/233 |
| 3,304,606 | 2/1967 | O'Connell | 30/195 |
| 3,831,277 | 8/1974 | Nagata . | |
| 3,842,501 | 10/1974 | Honma . | |
| 3,888,005 | 6/1975 | Bagwell . | |
| 3,996,664 | 12/1976 | Lee . | |
| 4,170,064 | 10/1979 | Senk . | |
| 4,660,285 | 4/1987 | Pracht | 30/195 |
| 4,769,913 | 9/1988 | Kuramochi . | |
| 4,912,846 | 4/1990 | Yu . | |
| 4,949,460 | 8/1990 | Sterk . | |

FOREIGN PATENT DOCUMENTS

| | | | |
|---|---|---|---|
| 70103 | 7/1948 | Denmark | 30/195 |
| 0451381A | 10/1991 | European Pat. Off. . | |
| 932476 | 9/1955 | Fed. Rep. of Germany . | |
| 3506386A | 8/1986 | Fed. Rep. of Germany . | |
| 132182 | 9/1919 | United Kingdom | 30/233.5 |
| 699498 | 11/1953 | United Kingdom . | |

*Primary Examiner*—Richard K. Seidel
*Assistant Examiner*—Paul M. Heyrana, Sr.
*Attorney, Agent, or Firm*—Philip P. McCann

[57] ABSTRACT

Synthetic fiber safety cutting scissors comprising a pair of first and second elongated scissor blades, each having an inner side and an outer side and a continuous cutting edge, a plurality of non-cutting protrusions part of the blade, and a gripping means; and a means for pivotally securing said first and second scissor blades to each other with said inner sides facing towards each other such that the said cutting edges cooperate with each other to cut strands of synthetic fiber. It has been found that with the protrusions that foreign objects such as fingers may be prevented from being intersected at the cutting edge.

6 Claims, 1 Drawing Sheet

SAFETY SCISSORS

This application is a continuation-in-part of patent application Ser. No. 790,849 filed Nov. 12, 1991, now abandoned.

BACKGROUND OF THE INVENTION

The invention relates to safety scissors used to cut synthetic fibers. In particular, the invention is directed to scissors having non-cutting protrusions incorporated with a continuous cutting edge, whereby the protrusions are spaced to prevent foreign objects, such as fingers, from coming into contact with the nip of intersecting continuous cutting edges.

Various types of scissors are well known in the art. With the conventional scissors, the one scissor blade, when the scissors are closed, overlaps the cutting edge of the other scissor blade with its cutting edge throughout a portion of the length thereof so that between the cutting edges and the base of the cutting edge gap there is a nip which cuts the material. Most of such scissors are used to cut hair or cut other articles including synthetic fibers. However, as well known to one who has used scissors, foreign objects such as fingers can come between the cutting edges of the scissors, resulting in injuries.

Numerous types of scissors include projections extending from the cutting edge but providing teeth-like gaps as shown in U.S. Pat. No. 4,170,064 and 4,660,285. Thinning scissors with two serrated cutting edges are already known and shown in German Patent Specification No. 932,476. In these at least one scissor blade has round cutting edge at the bottom of each of the gashes. It is also known for scissors to have serrated cutting edge of the scissor blade made corrugated for use in hair trimming.

However, such scissors have sharp serrated edges and still can pose a safety problem. Furthermore, such scissors were not designed for use in cutting synthetic fibers such as nylon, polyester, etc. It is the objective of the present invention to provide a safety scissor such that foreign objects such as fingers are prevented from entering the cutting edge of the scissor blades.

SUMMARY OF THE INVENTION

The object of the invention is safety scissors of the generic type eliminating a safety hazard for the user. According to the invention, the scissors comprise a) a pair of first and second elongated scissor blades each having an inner side, a continuous cutting edge on the inner side, a plurality of non-cutting protrusions incorporated with each blade and spaced along said blade wherein the protrusions may have the same or dissimilar lengths from the cutting edge, and gripping means on each blade; and b) means for pivotally securing said first and second scissor blades to each other with said inner sides facing towards each other such that said cutting edges cooperate with each other to cut when said first and second scissor blades are pivotally moved towards each other from an open position to a closed position and said non-cutting protrusions overlap with clearance with each other as said first and second scissor blades are pivotally moved towards each other from an open position to a closed position.

In an advantageous development of the invention, the non-cutting protrusions of the first and second scissor blades are spaced to prevent foreign objects such as fingers to enter into the area of the cutting edges. Such an advantage is useful in cutting strands of synthetic fibers.

BRIEF DESCRIPTION OF THE DRAWINGS

An embodiment of the invention will now be described by way of example, and with reference to the drawing in which.

DETAILED DESCRIPTION OF THE PREFERRED EMBODIMENT

In the following detailed description there is described a preferred embodiment of the invention. It will be recognized that although specific terms may be used in describing the preferred embodiment, these are used in the descriptive sense and are not generically and are used for the purposes of description and not of limitation. The invention is susceptible to numerous changes and variations within the spirit and the scope of the teachings herein as will be apparent to the skilled artist.

Figure 1:
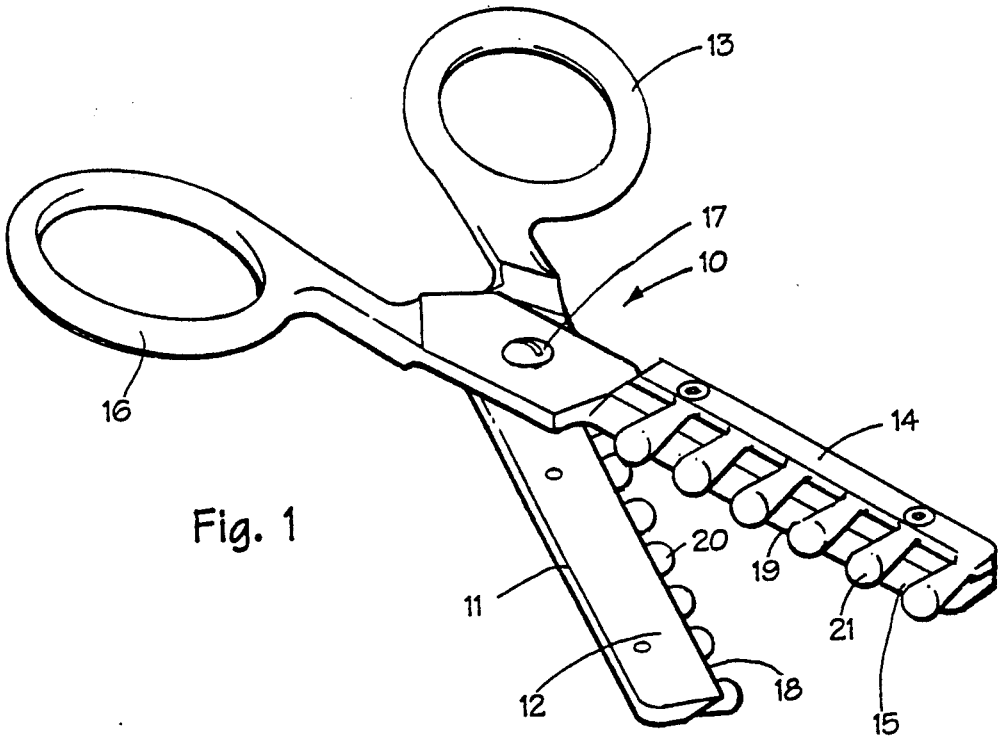
FIG. 1 is a perspective view of opened cutting scissors according to the invention.
Figure 3:
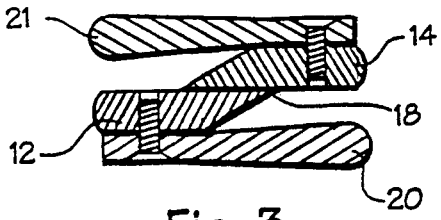
FIG. 3 is a sectional view of enlarged scale taken on the line 3—3 of FIG. 1.
Figure 2:
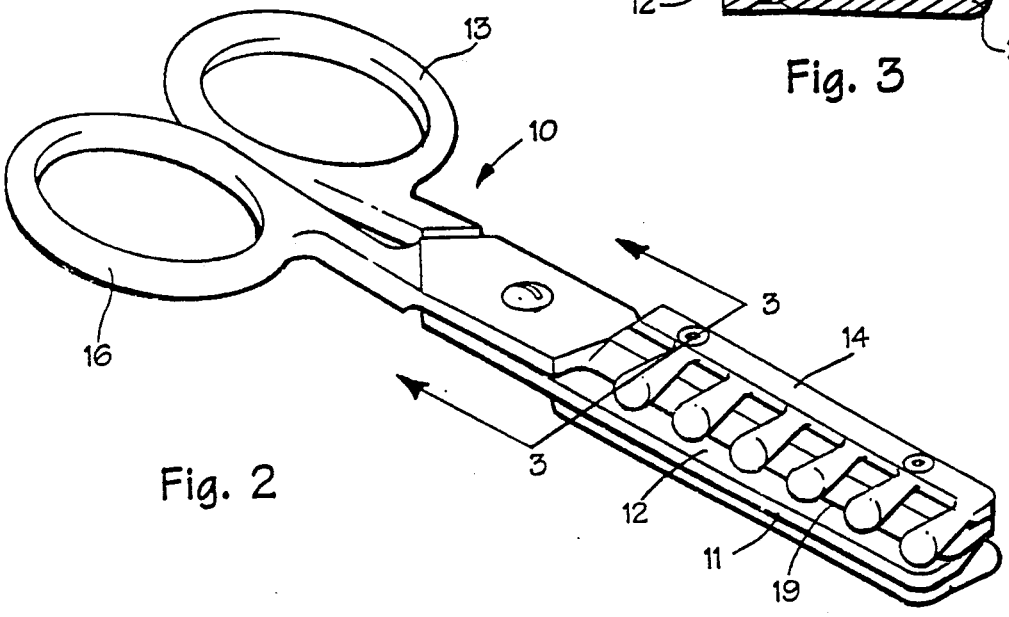
FIG. 2 is a perspective view of the closed scissors.

Now referring to the drawings illustrated in FIGS. 1 to 3 is a preferred embodiment of the scissors 10 of the present invention. The scissors 10 include a first scissor half 11 with a scissor blade 12 and a ring handle 13 and the reference numeral 14 denotes the other scissor half with a scissor blade 15 and a ring handle 16. The scissor halves 11 and 14 are connected to one another by means of a joint screw 17. The scissor blade 12 has a continuous sharp cutting edge 18, and the scissor blade 15 has a continuous sharp cutting edge 19. Furthermore, the scissor blade 12 has a series of non-cutting dull protrusions 20 and the scissor blade 15 has a series of non-cutting dull protrusions 21. Each of these protrusions 20, 21 are incorporated with the respective continuous cutting edge 18, 19 and are separately spaced along the respective blade 12, 15 as shown in FIG. 1 and 2. Said protrusions may be integral of each blade or attached. If attached, such protrusions may be of dissimilar material such as plastic. Furthermore, as shown in FIG. 3, each protrusion is distanced above the respective cutting edge sufficiently to provide clearance for the respective blade. As the protrusions overlap when the blades 12, 15 are moved toward each other, the clearance between protrusions is sufficient to avoid a pinch point generally from $\frac{1}{8}$ inch to $\frac{3}{8}$ inch and preferably $\frac{1}{4}$ inch.

Each continuous cutting edge 18, 19 as shown in FIG. 1 is a linear smooth cutting edge formed by a ground or a shaped edge that intersects with the bottom flat side of each scissor blade 14, 15. Although these edges are shown as linear, other embodiments include bowed edges or slightly curved to facilitate cutting. Each non-cutting dull protrusion 20,21 as shown in FIGS. 1 and 2 extend outwardly above each continuous cutting edge 18, 19 forming a blunt projection. In the present embodiment the protrusions are shown to be oval shaped enhancing filaments to flow over the surface thereof.

Individual scissor blades are aligned such that when they are pivoted amongst the screw 17 that the two continuous cutting edges 18, 19 intersect to form a nip to cut the fiber. Furthermore, the two non-cutting dull protrusion 20 and 21 overlap with clearance of about ¼ inch. The distance between each of non-cutting dull areas is spaced linearly along the blade to prevent human fingers from coming in contact with the nip in between the two continuous cutting edges. General length of separation of such dull areas is about ⅜ inch.

It has been found that use of scissors can be used to cut synthetic polymers such as polyester and nylon. In particular, when a strand of such synthetic fibers is running, they are segregated into the cutting edges and cut without danger of cutting the personnel using the scissors. Such scissors may be made of normal materials including steel or part supplemented with plastic. The invention has been described with considerable detail with reference to its preferred embodiments. However, variations and modifications can be made within the spirit and scope of the invention as described in the foregoing specification and defined in the appended claims.

What is claimed is:

1. Scissors comprising a) a pair of first and second linear elongated scissor blades each having an inner side, a continuous cutting edge on said inner side, a plurality of non-cutting protrusions incorporated with each blade and spaced, both outwardly from and along said blade, and gripping means on each blade, and b) means for pivotally securing said first and second scissor blades to each other with said inner sides facing towards each other whereby when the blades are pivotally moved toward each other from an open position to a closed position, a clearance between the overlapping protrusions of ⅛ to ⅜ inch is formed.

2. Scissors according to claim 1 wherein said non-cutting protrusions are distanced about ⅓" from each other.

3. Scissors according to claim 1 wherein said non-cutting protrusions are of plastic and attached to said blade.

4. Fiber cutting scissors adapted to cut selected strands of spun fiber comprising a) a pair of first and second elongated linear scissor blades each having an inner side, a continuous cutting edge on said inner side, a plurality of non-cutting protrusions incorporated with each blade and spaced both outwardly from and along said blade and gripping means on each blade; and b) means for pivotally securing said first and second scissor blades to each other with said inner sides facing towards each other whereby when the blades are pivotally moved toward each other from an open position to a closed position to cut strands of synthetic fiber, a clearance between overlapping protrusions of ⅛ to ⅜ inch is formed.

5. Fiber cutting scissors of claim 4 wherein said non-cutting protrusions are distanced about ⅓" from each other.

6. Scissors according to claim 4 wherein said non-cutting protrusions are of plastic and attached to said blade.

* * * * *